US006530808B1

(12) United States Patent
Hosler, Sr. et al.

(10) Patent No.: US 6,530,808 B1
(45) Date of Patent: Mar. 11, 2003

(54) COAXIAL CABLE CONNECTOR

(75) Inventors: Robert C. Hosler, Sr., Marysville; Robert L. Fisher, Jr., Palmyra, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/690,228

(22) Filed: Oct. 17, 2000

(51) Int. Cl.[7] ..... H01R 9/05
(52) U.S. Cl. ..... 439/585; 439/578
(58) Field of Search ..... 439/585, 578–584

(56) References Cited

U.S. PATENT DOCUMENTS

| | | | | |
|---|---|---|---|---|
| 3,221,290 A | | 11/1965 | Stark et al. | 339/177 |
| 3,297,978 A | | 1/1967 | Stark | 339/177 |
| 3,366,920 A | * | 1/1968 | Laudig et al. | 439/585 |
| 4,047,788 A | | 9/1977 | Forney et al. | 339/177 R |
| 4,096,627 A | | 6/1978 | Forney et al. | 29/628 |
| 5,066,249 A | * | 11/1991 | Doye et al. | 439/585 |
| 5,273,458 A | | 12/1993 | Fisher, Jr. et al. | 439/585 |
| 5,490,801 A | | 2/1996 | Fisher, Jr. et al. | 439/585 |
| 5,994,975 A | * | 11/1999 | Allen et al. | 333/26 |

* cited by examiner

*Primary Examiner*—P. Austin Bradley
*Assistant Examiner*—Ross Gushi
(74) *Attorney, Agent, or Firm*—Harrington & Smith, LLP

(57) ABSTRACT

An electrical connector member for a coaxial cable. The connector member comprises a first section and a second section. The first section has two or more portals therein, each portal adapted to guide an indentor of a crimping tool into a predetermined position over a crimp area of an electrical contact in the member. The second section includes a conductor receiving section of the electrical contact, the conductor receiving section having a diameter adapted to receive a center conductor of the cable. Each crimp area is located on the conductor receiving section, wherein an electrical connection is formed by crimping the electrical contact to the conductor at each crimp area using the indentors. The crimped connection provides a substantially matched impedance in that section of the connector.

15 Claims, 17 Drawing Sheets

COAXIAL CABLE CONNECTOR

BACKGROUND OF THE INVENTION

1. Field of the Invention

The present invention relates to RF coaxial cable connectors and more particularly to a coaxial cable connector having improved voltage standing wave ratio through minimal impedance mismatch.

2. Brief Description of Earlier Developments

In most coaxial connector designs, it is a common practice to either crimp or solder the center conductor of the cable before assembling the center contact inside the connector. Crimping the center contact is a desirable termination method due to the lower applied cost of the cable assembly. Examples of crimping an electrical terminal to an exposed end of an inner conductor of a coaxial cable can be found in U.S. Pat. Nos. 5,273,458 and 5,490,801. In these cases, the center contact of the connector is terminated to the coaxial cable conductor via a crimping tool before assembly within the outer conductor and the dielectric member. However, in connector designs that incorporate a center contact pre-assembled with the remainder of the connector, termination must be made through portals in the outer conductor shell of the assembly. Termination of the center conductor of the coaxial cable in these designs can also be either crimp or solder. Methods of crimping through portals are described in U.S. Pat. Nos. 3,297,978, 4,047,788, 4,096,627. However, portal style crimps described to date have worse RF performance levels, due to the impedance mismatch effects of the portals. U.S. Pat. Nos. 3,297,978; 4,047,788; 4,096,627 describe the crimping of the center contact of the connector through opposed crimp portals, but fail to address the resulting electrical effects of the crimped connector. With the increased need for higher frequency ranges to support for example the expanding wireless communications markets, RF connectors used in telecommunication systems are required to operate at higher frequency ranges and with lower losses to make these systems function at their peak performance. Therefore, it would be desirable to be able to connect a coaxial cable conductor to a conductor receiving member via portals in the outer conductor shell of the connector, while at the same time optimizing the impedance of the connector as well as enhancing the overall RF performance of the connector, which are results not achieved or realized using any of the conventional connectors.

SUMMARY OF THE INVENTION

The present invention is directed to in a first aspect, an electrical connector member for a coaxial cable. In one embodiment, the connector member comprises a first section and a second section. The first section has two or more portals therein, each portal adapted to guide an indentor of a crimping tool into a predetermined position over a crimp area of an electrical contact in the member. The second section includes a conductor receiving section of the electrical contact, the conductor receiving section having a diameter adapted to receive a center conductor of the cable. Each crimp area is located on the conductor receiving section, wherein an electrical connection is formed by crimping the electrical contact to the conductor at each crimp area using the indentors. The crimped connection provides a substantially matched impedance in that section of the connector.

In another aspect, the present invention is directed to an electrical connector member for a coaxial cable. In one embodiment, the member comprises a first section having four portals and a second section including a conductor receiving section of an electrical contact in an interior section of the connector. Each portal is adapted to align a corresponding indentor of a crimping tool over a predetermined crimp area on the electrical contact. Each indentor is aligned adjacent to its respective portal as the connector member is inserted into the positioner of the crimping tool. The conductor receiving section has a diameter adapted to accommodate a center conductor of the cable. Preferably, the contact is adapted to be assembled in the connector member before a crimping operation. In the preferred embodiment, the crimp on each crimp area forms an electrical connection between the contact and the conductor and provides a substantially matched impedance for the crimp section of the connector.

In another aspect, the present invention is directed to a method of making a crimp-style coaxial electrical connector assembly having a generally uniform impedance. In one embodiment, the method comprises providing a coaxial electrical connector having an inner conductor, an outer conductor and a dielectric element separating the inner and outer conductor. A coaxial cable with a center conductor is provided and the inner conductor is engaged with the center conductor. The inner conductor is crimped to the center conductor through at least two openings in the outer conductor. The crimping step creates an area of impedance mismatch on the connector that is compensated for to provide the generally uniform impedance across the connector.

In a further aspect, the present invention is directed to a coaxial electrical connector with an inner conductor crimped to a center conductor of a coaxial cable through an outer conductor. In one embodiment, the improvement comprises the outer conductor having an inner diameter selected to compensate for an impedance mismatch created by the crimp, so that the connector has a generally uniform impedance thereacross.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
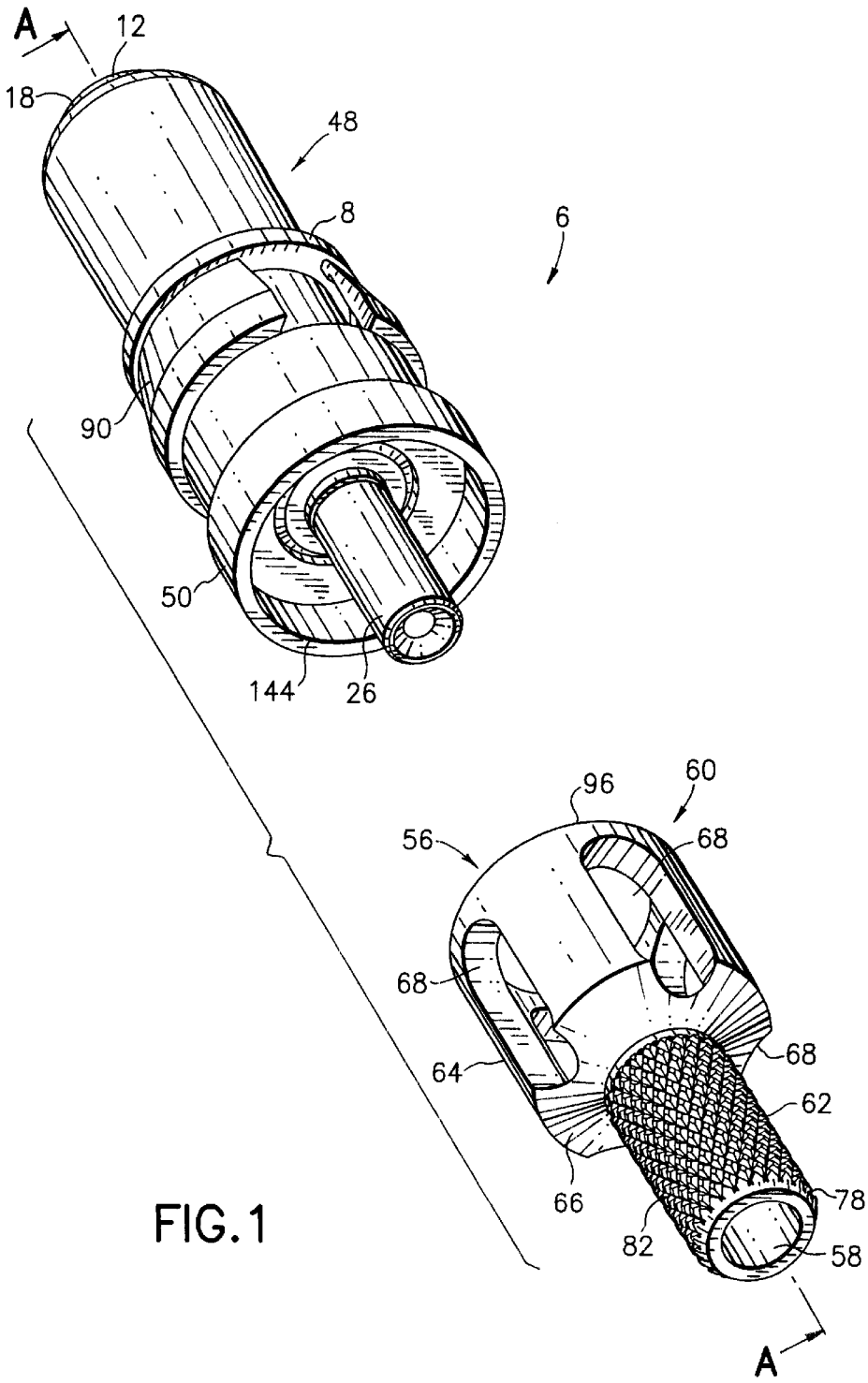
FIG. 1 is an exploded, perspective view of a connector sub-assembly incorporating features of the present invention.

Referring to FIG. 1, there is shown an exploded perspective view of a connector sub-assembly 6 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 5:
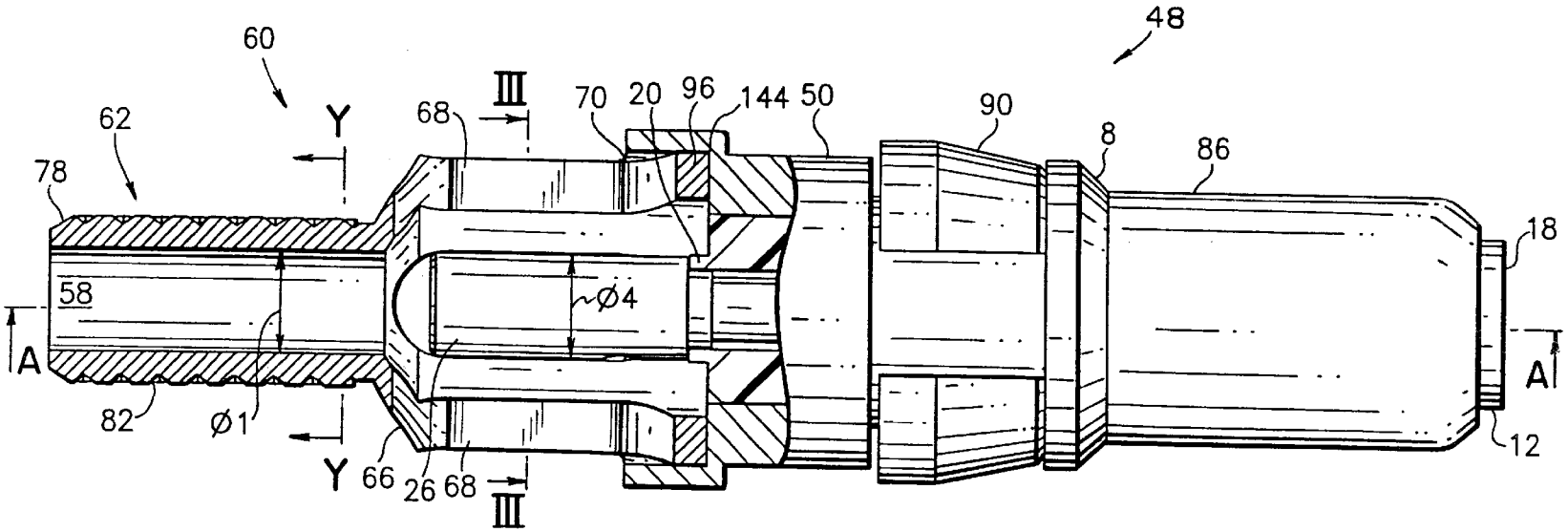
FIG. 5 is a partial cross-sectional view of the connector sub-assembly of FIG. 1 taken along the line A—A before the crimping step.
Figure 6:
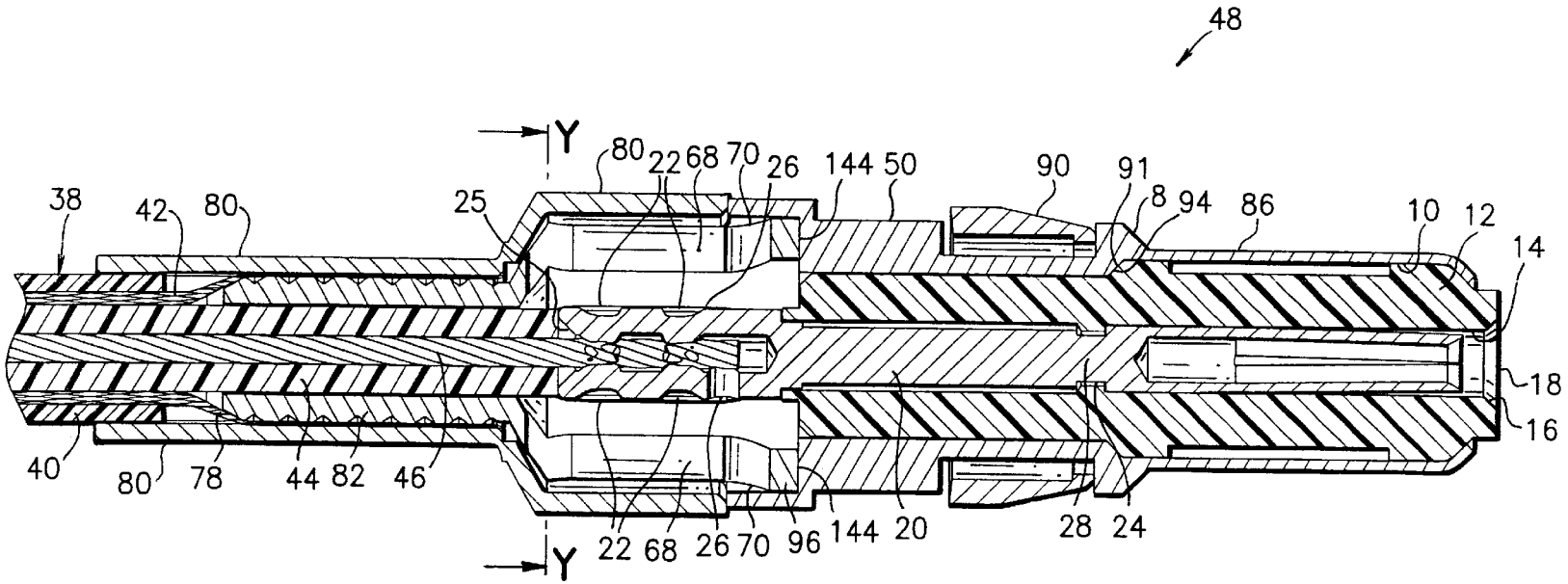
FIG. 6 is a cross-sectional view of an assembled (i.e. after the crimping step) connector sub-assembly incorporating features of the present invention.

In one embodiment, the connector 6 can be made from multiple machined pieces. Generally, the front end 48 and the back end 60 are adapted to be mechanically and electrically coupled together. Referring to FIGS. 1, 5 and 6, the flange 144 can seat circumferentially against a complimentary portion 96 of the back end 60. In one embodiment, the front end 48 and back end 60 may be coupled together by soft soldering the sub-assemblies together. In an alternate embodiment, the front end 48 and the back end 60 may be coupled together using any suitable electrical and mechanical connection method or device. In an alternate embodiment, the connector 6 can be manufactured as a one-piece connector. The front end 48 can include a pin or socket assembly adapted for mating with a complimentary connector assembly. The back end 60 can include two or more portals 68, and a hollow bore 58 that is adapted to receive a coaxial cable.

The connector 6 is adapted to allow the center conductor of the coaxial cable to be connected, both electrically and mechanically, to a conductor receiving member 26 of the connector 6, the connection optimizing the impedance of the connector as well as the RF performance of the connector. In this embodiment, the conductor receiving member 26 can be crimped to the center contact of the coaxial cable. It is a feature of the present invention to provide an improved mechanism and method of crimping a contact to a conductor through a portal.

Figure 8:
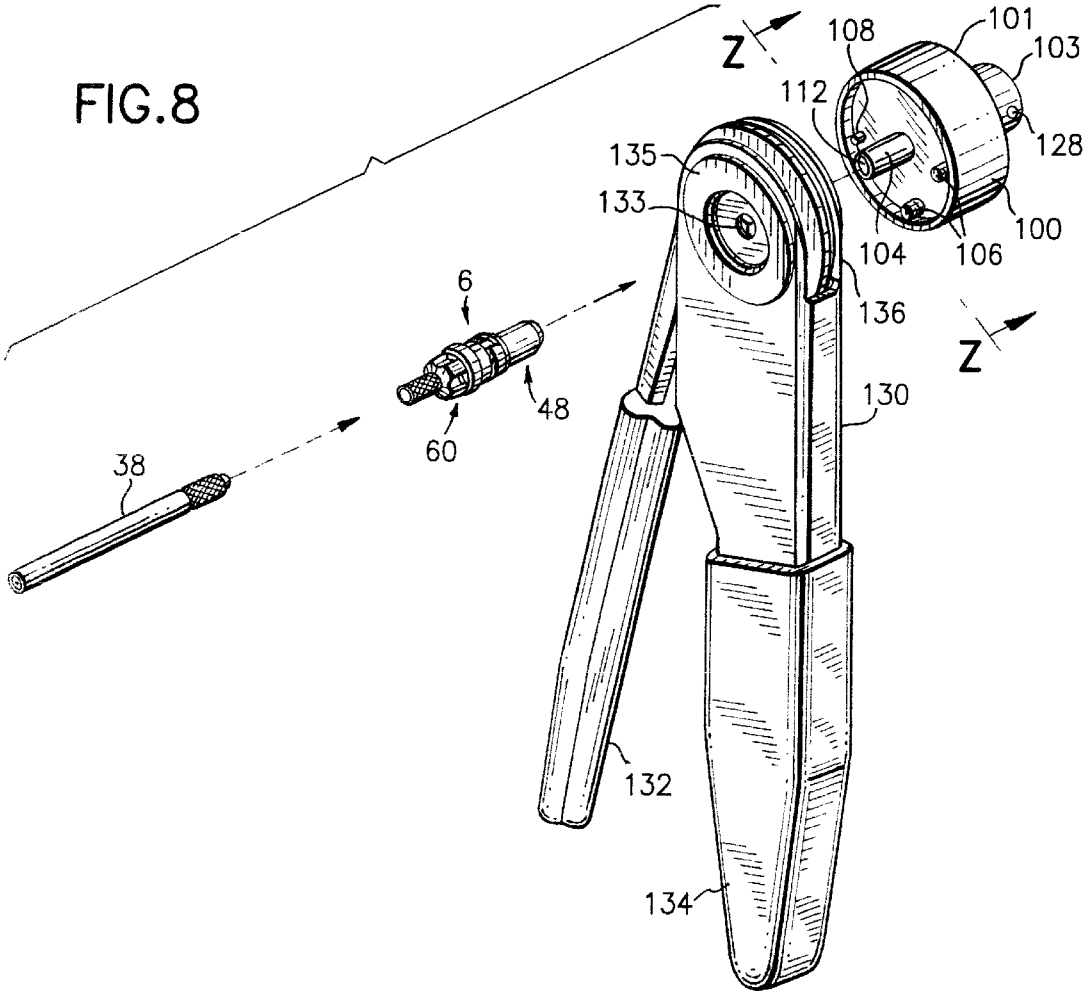
FIG. 8 is an exploded, perspective view of a crimping tool assembly incorporating features of the present invention.
Figure 12:
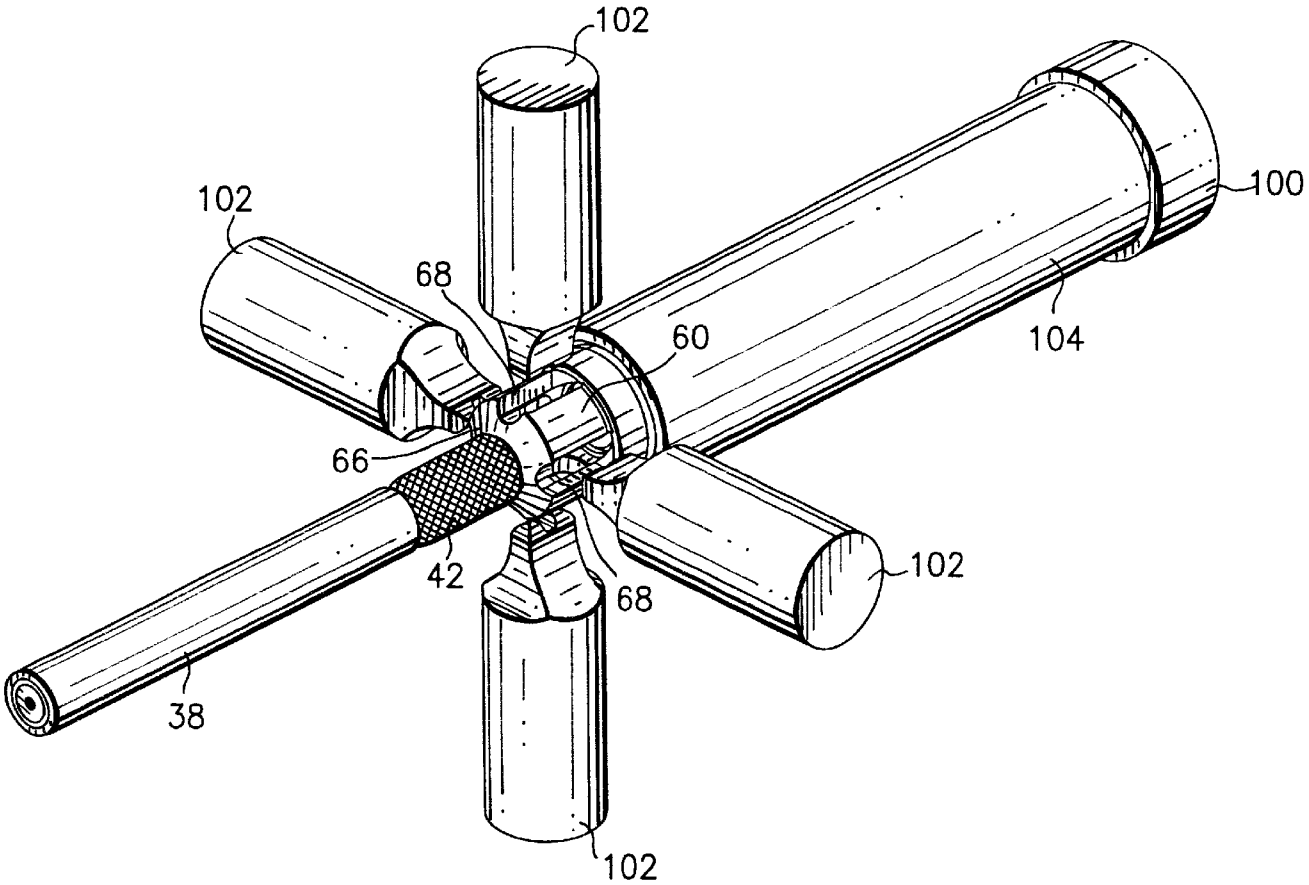
FIG. 12 is a perspective view of one embodiment of a connector sub-assembly incorporating features of the present invention inserted into a positioner device and before the indentors enter the portals for crimping.

As shown in FIGS. 1, 5 and 6, the connector 6 can include two or more portals 68 extending through the back end 60 of the connector 6 into a hollow section or bore 56. Each portal 68 provides access for insertion of an indentor 102 of a crimping tool 130 as shown in FIGS. 8 and 12. The design of each portal 68 is such that a subsequent crimp exerted by the crimping tool places a crimp 22 in a precise location on the conductor receiving member 26 as shown in FIG. 6. It is a feature of the present invention that by locating a crimp in a precise location on the conductor receiving member 26, by selecting the dimensions of the outer shell and each portal, and by using a crimp ferrule, that the impedance of the connector is optimized and the overall RF performance of the connector 6 is enhanced. These are significant improvements and enhancements that are not realized in any prior portal connector design.

Figure 7:
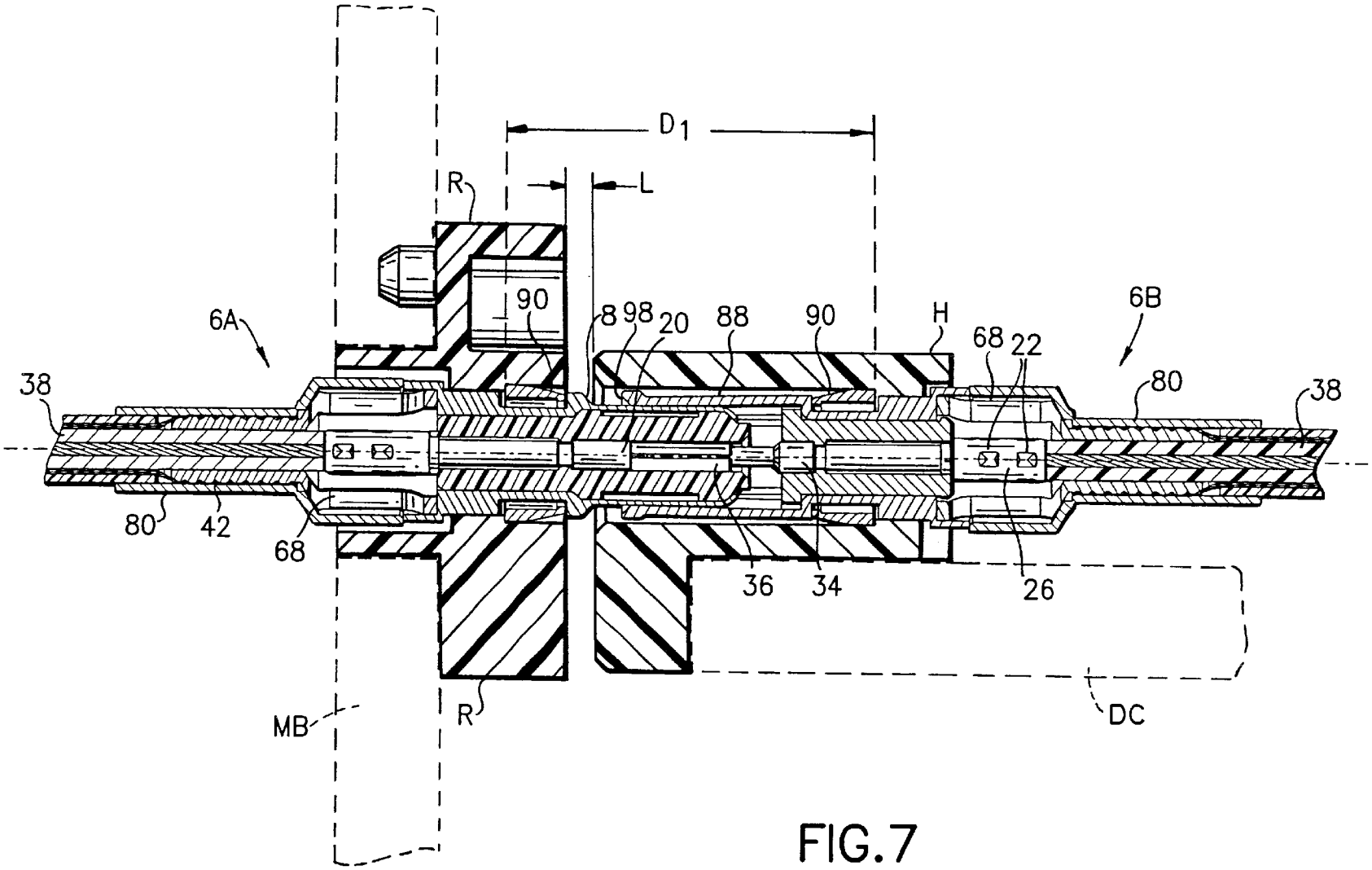
FIG. 7 is a cross-sectional view of a mated connector assembly incorporating features of the present invention on both connectors.

As shown in FIGS. 1 and 6, connector 6 comprises plug (male) connector. Alternatively, the connector 6 may also take the form of an electrical receptacle (female) connector that is adapted to mate with the plug connector 6 of FIG. 1, as depicted in FIG. 7. Once cables 38 are secured thereto, plug connector 6A and receptacle connector 6B are secured within a housing R and housing H, respectively as shown in FIG. 7. Plug connector 6A mounts to motherboard MB and receptacle connector 6B mounts to daughter card DC.

The connector 6 can include a hollow bore 58 at one end of the back end 60. The hollow bore 58 is generally adapted to be inserted between certain layers of a coaxial cable as described below. As shown in FIG. 6, a coaxial cable generally has an outer layer or jacket 40 covering an electrically conducting shielding layer 42, which in turn covers a dielectric or insulation layer 44. In the central portion of the cable 38, and covered by the dielectric layer 44, is an electrically conducting center conductor 46. In one embodiment, the coaxial cable 38 can be 26 AWG coaxial cable, such as for example ALPHA WIRE CO. P/N 9316, M17/113-RG316. However, in alternate embodiments, the coaxial cable 38 can be any suitable cable for high frequency communication applications.

The bore 58 extends between the dielectric layer 44 and the shielding layer/cable braid 42. Referring to FIG. 5, an inner diameter Ø1 of the hollow bore 58 is generally sized just large enough to accommodate a center conductor 46 and a dielectric layer 44 of a coaxial cable 38. In one embodiment, the inner diameter Ø1 of the hollow bore 58 can be approximately 0.063 inches (1.600 millimeters) in order to accommodate a coaxial cable having a dielectric diameter of approximately 0.060 inches (1.524 millimeters). In an alternate embodiment, the inner diameter Ø1 of the hollow bore 58 can be sized to any suitable dimension in order to accommodate a desired coaxial cable 38. The knurled exterior surface 82 of back end 60 abuts cable braid/shielding layer 42.

Referring to FIGS. 1 and 5, in one embodiment, the back end 60 of the connector 6 can include a tapered diameter 66. The tapered diameter 66 can be approximately between the section 64 of back end 60 that includes the portals 68 and the section 62 that includes the hollow bore 58. As shown in FIGS. 1, 5 and 6, an outer surface of the section 62 can include a conductive crimping surface 82 over which the conductive shielding layer 42 of the cable 38 can be secured. In one embodiment, the crimping surface 82 can comprise a knurled surface. Once bore 58 is inserted between insulation layer 44 and shielding layer 42 of cable 38, a crimp ferrule 80 can be positioned over the back end 60 of connector 6 in order to secure the shield layer 42 positively to the connector 6. In an alternate embodiment, any suitable surface and manner of connection can be used to establish a mechanically and electrically secure conductive bond between the connector 6 and the shield layer 42.

The crimp ferrule 80 generally comprises a conductive member adapted to secure, both mechanically and electrically, the cable 38 and the shield layer 42 to the connector 6. Referring to FIG. 6, in this embodiment, the crimp ferrule 80 covers the portals 68 and provides shielding effectiveness against radio frequency ("RF") leakage.

Referring to FIGS. 1, 5 and 6, the connector 6 may also include a chamfered edge 78 along the leading edge of back end 60 near hollow bore 58 where the cable 38 is inserted. The chamfered edge 78 can be used to separate the shield layer 42 from the dielectric layer 44 upon insertion of the coaxial cable 38 into the connector 6.

Figure 2:
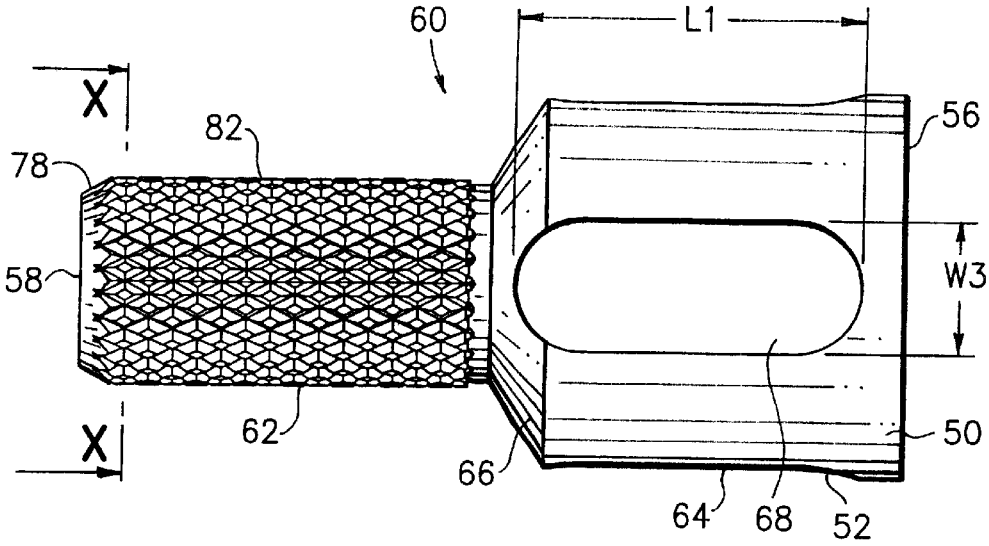
FIG. 2 is an elevational view of a portion of the connector sub-assembly shown in FIG. 1 for purposes of highlighting the dimensions of a portal.

In one embodiment, the connector 6 is symmetrical and can include four portals 68, also referred to as portholes, each portal 68 being spaced around a circumference of the back end 60 of connector 6 at approximately 90° from an adjacent portal. In an alternate embodiment, the connector 6 can include any suitable number of portals 68. Referring to FIG. 2, each portal 68 generally has a length L1 greater than its width W3. In one embodiment, the length L1 of a portal 68 can be approximately 0.1700 inches (4.318 millimeters) while the width W3 of a portal 68 can be approximately 0.0650 inches (1.651 millimeters). In an alternate embodiment, the length and width of a portal 68 can be any suitable dimension. Referring to FIG. 12, the size of the portals 68 closely mirrors the size of the indenters 102 in the crimping tool 130 in order to guide the indenters 102 into the connector 6 and to an aligned position. In the aligned position, each indentor 102 is adapted to apply a crimp 22 in a predetermined location on the conductor receiving member 26 as shown in FIG. 6. The design of each portal 68, including its length, width and position, are generally adapted to optimize the impedance of the connector and to enhance its overall RF performance. The crimp tool will be described in more detail below.

Figure 3:
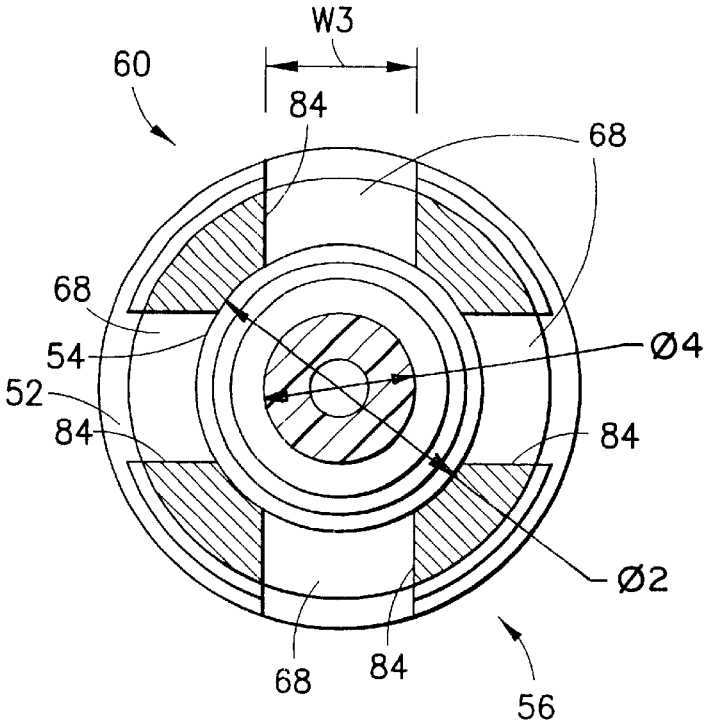
FIG. 3 is a cross-sectional view of the connector sub-assembly taken along line III—III in FIG. 5.

Generally, as shown in FIG. 3, the back end 60 of the connector 6 has an interior section 56. The inner diameter of interior section 56 is identified as Ø2. Back end 60 also includes two or more portals 68, with a width identified as W3. Centrally interposed within section 56 is the conductor receiving member 26 with an outer diameter of Ø4. As is known in the industry, the impedance of a coaxial structure is a function of the inner diameter of the outer conductor, the outer diameter of the inner conductor, and the dielectric constant of the material that separates the inner and outer conductors. It is also known that the inclusion of slots in either the inner or outer conductor introduce disturbances in the coaxial structure, resulting in impedance changes in these areas. Referring to FIG. 3 in the current embodiment, the inner diameter Ø2 of the shell 50 in section 56 can be approximately 0.1310 inches (3.3274 mm). Also shown in FIG. 3 are portals 68. In this embodiment, as noted earlier, the width W3 of the portals 68 can be approximately 0.065 inches (1.651 mm). Referring to FIGS. 1, 5 and 6, the conductor receiving member, which generally comprises a hollow bore adapted to accommodate the center conductor 46 of the cable 38, has, in this embodiment, an outer diameter Ø4 of approximately 0.0625 inches (1.5875 mm). It is a feature of the present invention that the combination of the inner diameter Ø2 of section 56, the outer diameter Ø4 of conductor receiving member 26, and the width W3 of portals 68 are adapted such as to optimize the impedance of the connector and enhance the overall RF performance. However, in an alternate embodiment, such as those encountered when using a coaxial cable of either smaller or larger dimensions, the outer diameter Ø4 of conductor receiving member 46, the inner diameter Ø2 of section 56 of back end 60, and the width W3 of portals 68 in back end 60 can be any suitable dimension, provided that the combination of dimensions are adapted to achieve the optimized RF performance characteristics of a connector incorporating features of the present invention.

Referring to FIGS. 1, 5 and 6, the conductor receiving member 26 extends into the interior section 56 of connector 6. The conductor receiving member 26 generally comprises a hollow bore adapted to accommodate the center conductor 46 of the cable 38. As shown in FIG. 5, an outer diameter Ø4 of the conductor receiving member 26 is generally just large enough to accommodate the center conductor 26. In one embodiment, the outer diameter Ø4 of the conductor receiving member 26 is approximately 0.0625 inches (1.5875 millimeters.). However, in an alternate embodiment, the outer diameter Ø4 of conductor receiving member 26 can be any suitable dimension. It is a feature of the present invention that the outer diameter Ø4 of the conductor receiving member 26 be adapted, in conjunction with the design of back end 60 (including portals 68), to optimize the impedance of the connector and enhance the overall RF performance. Referring to FIG. 6, the conductor receiving member 26 is adapted to be crimped to the center conductor 46 at crimp points 22 in order to establish a secure mechanical and electrically conductive connection. The crimps are caused to be precisely located at the crimp areas 22 by the alignment of the indentors 102 in each of the portals 68 as shown in FIG. 12. As will be described in more detail below in conjunction with FIGS. 9–13, a stop shoulder 110 in positioner 100 locates connector 6 relative to indentors 102 for the crimping step. By locating the crimp areas 22 in precise locations on the member 26, the impedance of the connector is optimized and the VSWR of the connector is greatly improved, which are results not realized in other portal crimp designs. It is a feature of the present invention that the design of the portals 68 positions the indenters 102 in the aligned position to locate the crimps over the predetermined crimping areas 22 of connector 6. The location of the crimp is a factor in the impedance matching and VSWR performance of the connector 6.

Figure 4:
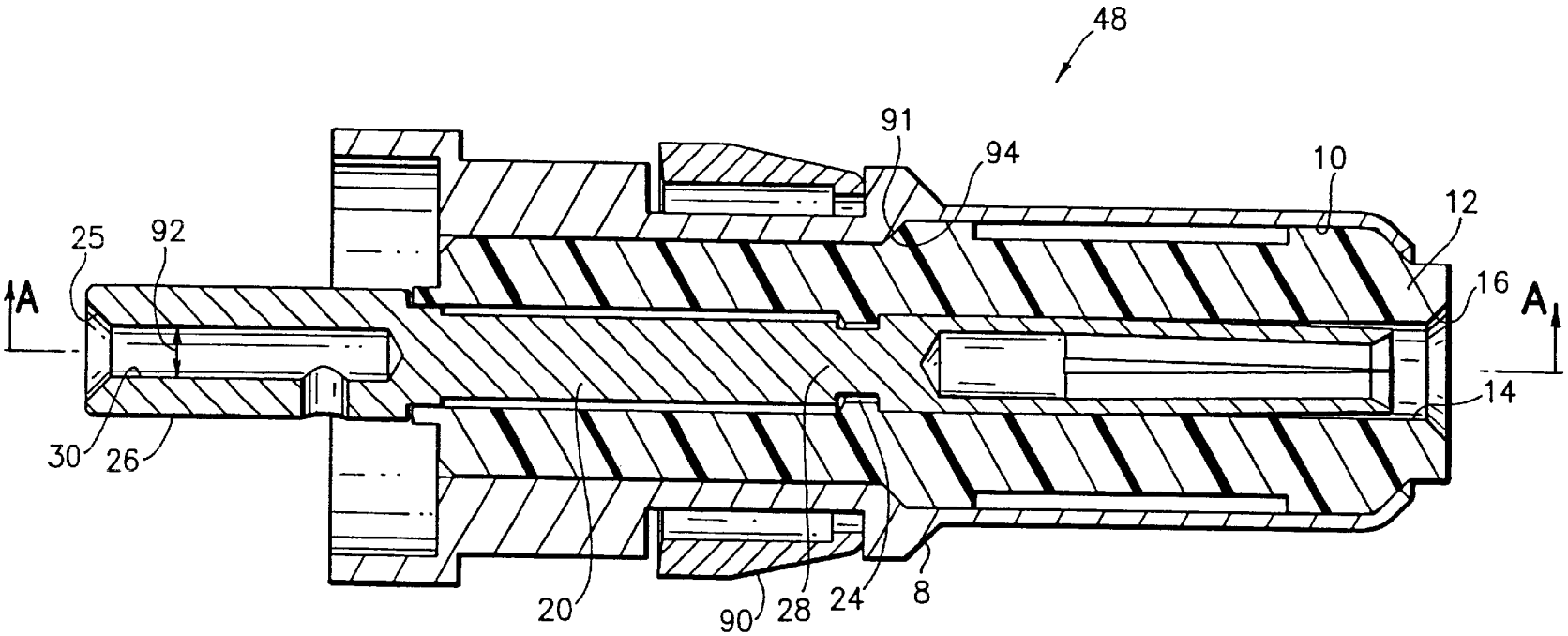
FIG. 4 is a cross-sectional view of the front end of the connector sub-assembly of FIG. 1 taken along the line A—A before the crimping step.

As shown in FIGS. 1 and 3, the interior of the connector 6 in the front end 48 is generally cylindrical. Referring to FIGS. 4 and 6, a stepped diameter 91 in the front end 48 provides a circumferential shoulder stop 94 within the generally hollow interior 10 against which a generally cylindrical dielectric insert 12 is seated when assembled into the interior 10. The dielectric insert 12 is generally cylindrical in form and is provided with a central bore 14 having a chamfered entryway 16 at the receptacle end 18. The electrical contact 20 is generally supported within the bore 14 before insertion into front end 48. In one embodiment, the contact 20 may also be provided with a reduced neck portion 24 retained in a relatively reduced neck portion 28 of the bore 14 to help secure the contact 20 within the bore 14.

Figure 11:
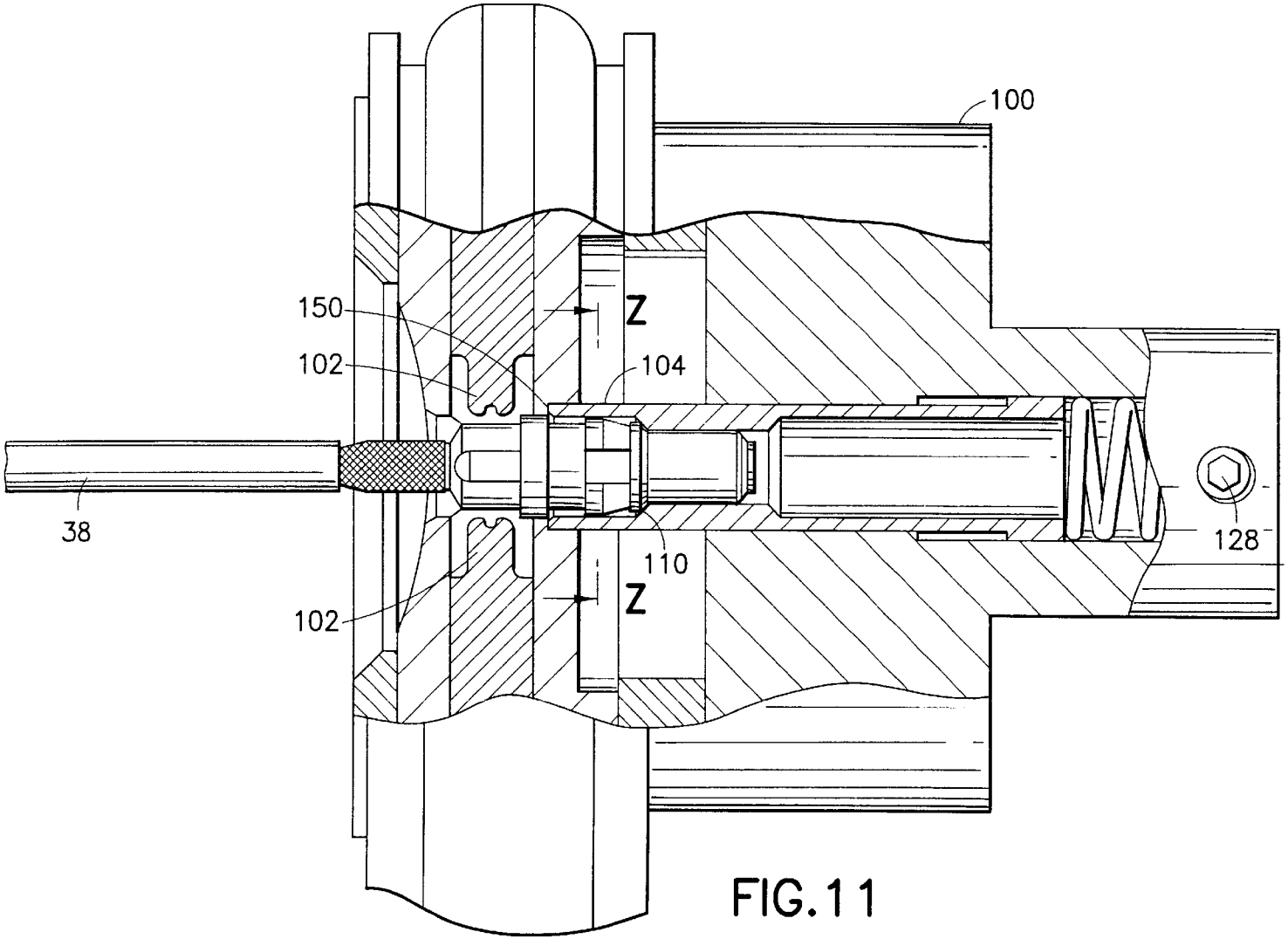
FIG. 11 is an elevational view of a connector sub-assembly of the present invention fully inserted into the crimp tool, but before the crimping step, including a partial cross-sectional view of the locator portion of the positioner and the crimp tool.

The front end 48 of connector 6 may also include a pair of shoulder stops 8 on the exterior shell 86 of the front end 48. The exterior shell 86 generally comprises a section of the conductive shell 50. Shoulder stops 8 serve to seat connector 6 against a complimentary shoulder stop 110 in a locator 104 of the crimping tool as shown in FIG. 11 during the crimping step.

Figure 13:
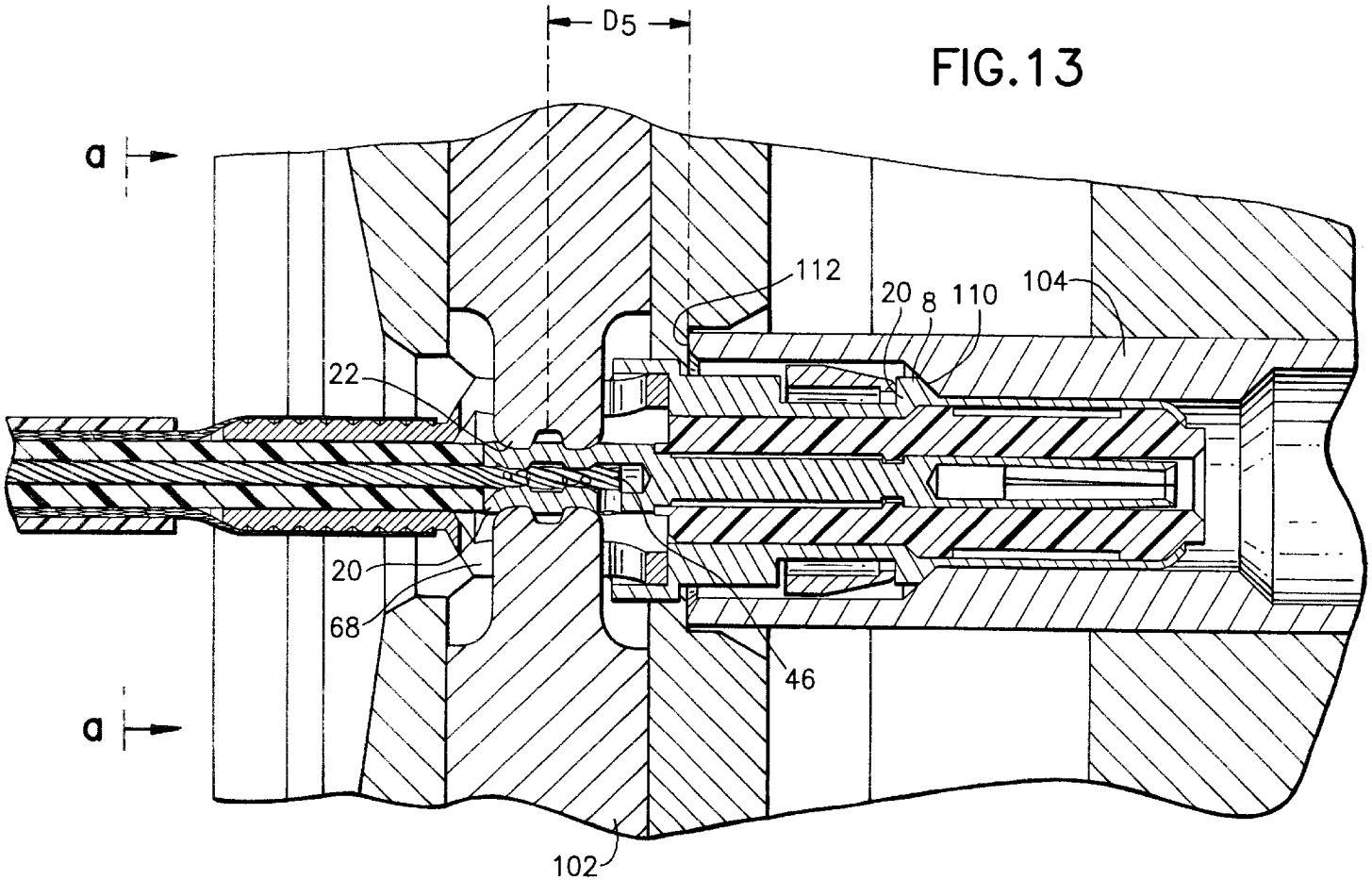
FIG. 13 is a cross-sectional view of a connector sub-assembly fully inserted into the crimp tool during the crimping step, i.e. showing the indenters crimping the contact to the conductor.

A crimping tool 130 and positioner 100 incorporating features of the present invention are shown in FIG. 8. The crimping tool 130 generally comprises two handles 132, 134 that are manually manipulated by squeezing the handles 132, 134. Tool 130 may also include a set of indenters secured within crimping port 133 adapted to close against the connector 6 at crimp areas 22 to crimp the conductor 46 to the member 26. In this embodiment, the tool 130 comprises a standard military commercial hand tool M22520/1-01 or part number AF8 sold by Daniels Manufacturing Corporation, also described in Military Specification MIL-C-22520/1 page 1. In an alternate embodiment, tool 130 could comprise any suitable device adapted to crimp conductor 46 to conductor receiving member 26 at crimp areas 22. As shown in FIGS. 6 and 13, the crimp at crimp areas 22 is adapted to provide a secure mechanical and electrically conductive connection between conductor 46 and conductor receiving member 26. It is a feature of the present invention to form a high performance, low loss electrical connection between the conductor 46 and contact 20 in a connector 6, while lowering the applied cost of the connector and cable assembly. Referring to FIGS. 8, 12 and 13, the indenters are adapted to close against a connector 6 (with a cable 38 placed therein) inserted into the tool from a first side 135. The indenters may be arranged so that two pairs of opposed indenters dies provide pairs of indents at four equally spaced crimp areas 22.

Figure 9:
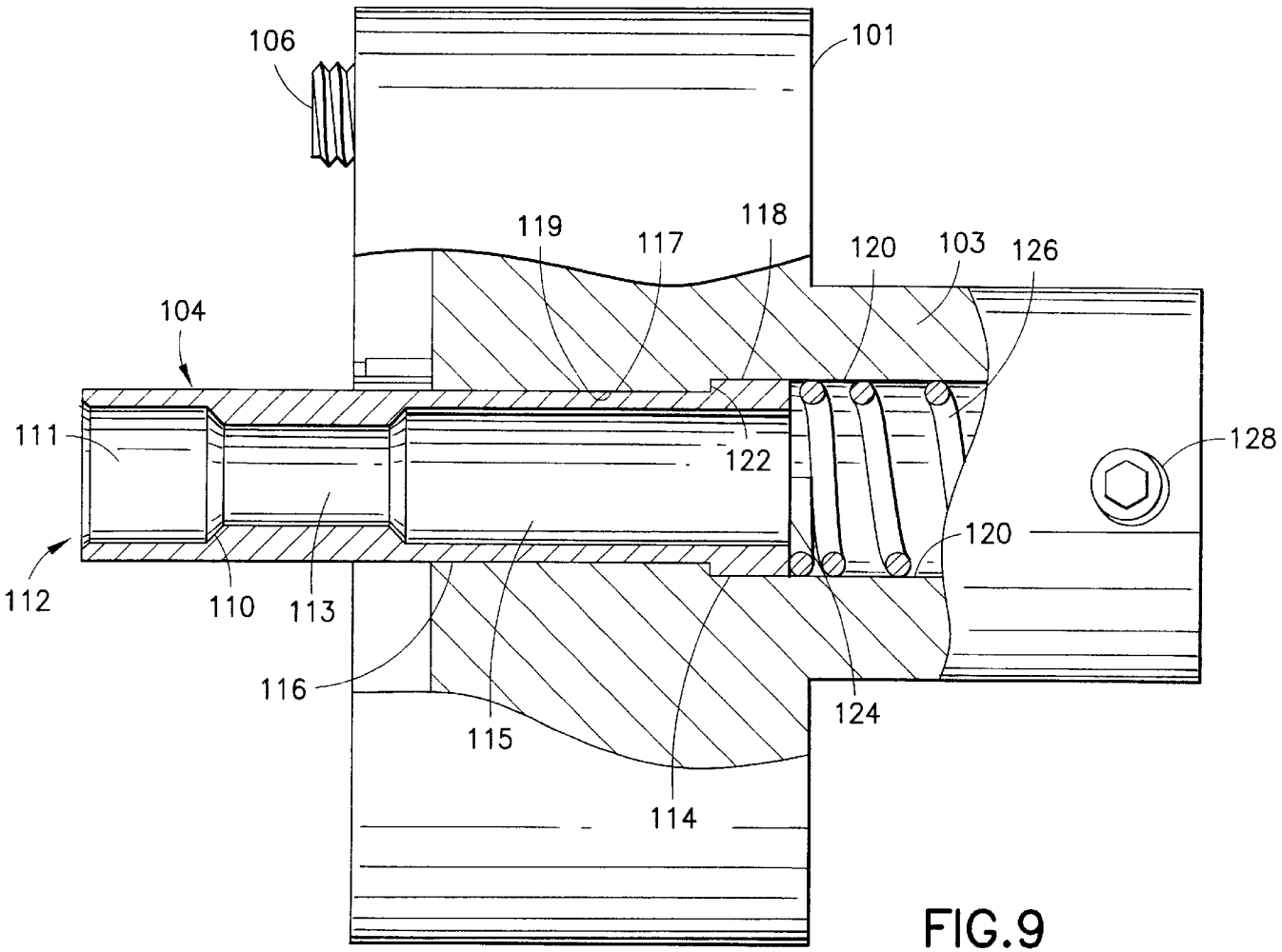
FIG. 9 is a partial cross-sectional view of the locator portion of the crimping tool assembly of FIG. 8 taken along the line z—z.

A set of indenters 102, is shown in FIGS. 8–13. Positioner 100 is generally adapted to precisely align and position connector 6 within the tool 130 for the crimping operation. Positioner 100 is mountable to tool 130 on side 136 of tool opposite to crimping port 133. Locating pin 108 and retaining screws 106 are adapted to be received in complimentary receptacles on side 136 of tool 130 in order to align and secure positioner 100 to tool 130. Positioner 100 can also include a spring-loaded locator shaft 104 that is adapted to receive connector 6. Referring to FIG. 9, locator shaft 104 is generally cylindrical and comprises first section 111, a second section 113 and a third section 115. Locator shaft 104 is generally adapted to be inserted into aperture 116 of positioner 100. The second section 113 generally has a smaller diameter than the first or third sections 111, 115.

Locator shaft 104 can include a reduced-diameter forward section 117 defining a forwardly facing ledge 114 which abuts a correspondingly rearwardly facing ledge 122 defined by a reduced diameter forward portion 119 of aperture 116 within which forward section 117 of shaft 104 is to be disposed. Locator shaft 104 can also include an annular collar 118 at its rearward end that is disposed with an enlarged rearward aperture section 120 of aperture 116. The rearwardly facing ledge 122 is defined between the rearward aperture section 120 and aperture 116 to retain locator shaft 104 assembled to positioner 100. Rear end 124 of locator shaft 104 is spring biasedly engaged by compression spring 126 mounted within rearward aperture section 120 and held therein by threaded insert 128. Alternatively, any suitable means can be used to retain locator shaft 104 in aperture 116. Locator shaft 104 described above receives plug connector 6A. A modified shaft not shown is used to receive receptacle connector 6B. Like shaft 104, the modified shaft receives receptacle 88 to precisely position portals 68 to accept indenters 102.

Figure 10:
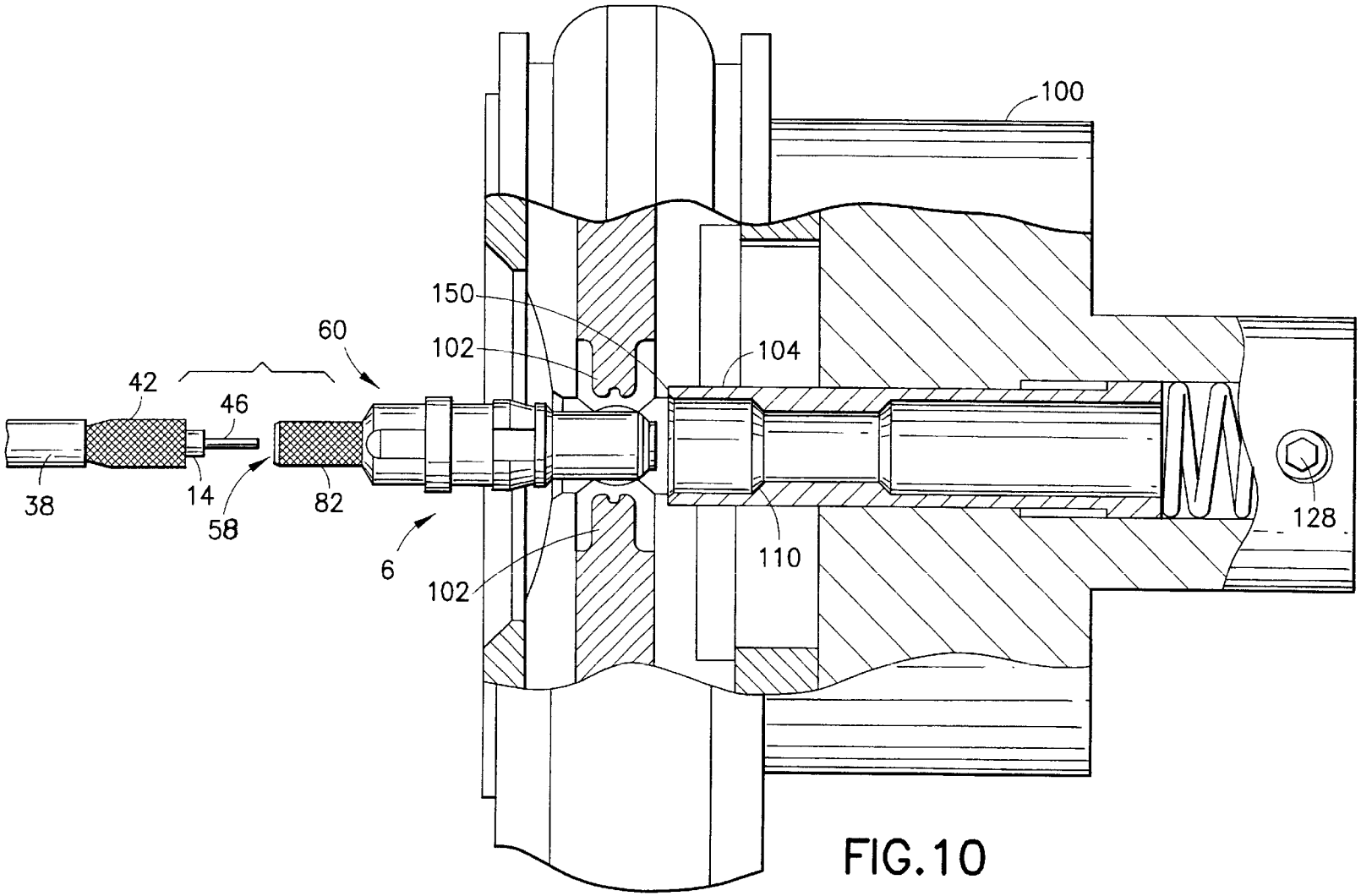
FIG. 10 is an elevational view of the components of a connector sub-assembly of the present invention partially inserted into the crimp tool.

Referring to FIGS. 8, 10 and 11, as positioner 100 initially mounts to tool 130, leading edge 112 of locator shaft 104 abuts a stop shoulder 150. As the mounting of positioner 100 to tool 130 continues, the locator shaft 104 is pushed back against the force of spring 126 as shown in FIG. 10. In other words, spring 126 ensures that locator shaft 104 maintains an abutting relationship with stop shoulder 150. Due to this arrangement, locator shaft 104 is precisely positioned relative to indentors 102. With the positioner fully mounted to tool 130, connector 6 can be precisely crimped to coaxial cable 38 as will be explained in more detail below.

Referring to FIGS. 10 and 11, locator shaft 104 can also include a stop shoulder 110 adapted to abut to a complimentary stop shoulder 8 of connector 6 when the connector 6 is inserted into the shaft 104. When connector 6 abuts stop shoulder 110, connector 6 is accurately located in the positioner 100 for a crimping operation. Since positioner 100 is accurately located relative to indentors 102, connector 6 is also accurately positioned relative to indentors 102. FIGS. 8 and 10 are illustrative of the general assembly of connector 6 and cable 38 prior to insertion into the tool 130.

FIG. 11 illustrates the basic positioning of connector 6 inserted into a locator shaft 104 with a cable 38 inserted into the connector 6. Referring to FIG. 6, generally, the cable 38 is inserted into the connector 6 by exposing and flaring the cable braid 42, then feeding the exposed conductor 46 and dielectric layer 44 through the hollow bore 58. The conductor 46 is funneled into the conductor receiving member 26 and the braid 42 travels outside bore 58 by the chamfer portions 25 as shown in FIG. 6. After the cable 38 has been inserted into the connector 6 and the conductor receiving member crimped as described herein, a crimping ferrule 80 is placed over the back end 60 as shown in FIG. 6 and crimped thereto, preferably, with a subsequent crimp process performed with a known crimping tool.

For crimping of the center conductor 46, a connector 6 and cable 38 are inserted into positioner 100 and tool 130 as shown in FIG. 11. Referring to FIG. 12, the portals 68 each engage an indentor 102 upon actuation of the tool 130. By squeezing the handles 132, 134 of tool 130, the indenters 102 are caused to crimp contact 20 at crimp locations 22, causing the crimping of conductor 46 as shown in FIG. 13.

Referring to FIGS. 11 and 13, in an example of one embodiment incorporating features of the present invention, when properly positioned against stop shoulder 150 of tool 130, an outer edge 112 of locator shaft 104 is a distance D5 of approximately 0.126 inches (3.2004 mm) from the centerlines of indenters 102, as described in Military Specification MIL-C-22520/1.

A cross-sectional view of a mated pair of complimentary connectors 6A and 6B is shown in FIG. 7. Connector 6A comprises a plug 36, while connector 6B comprises a receptacle 34. As seen in FIG. 7, the connectors 6A, 6B could be mated, so that a gap L exists between connector housings R, H. Preferably, gap L is approximately 0.045 inches (1.143 millimeters). When connector 6A is properly mated with the connector 6B, a nominal distance D1 between a far end of retention clips 90 on each of the connectors 6A and 6B can be approximately 0.578 inches (14.68 millimeters).

Figure 14:
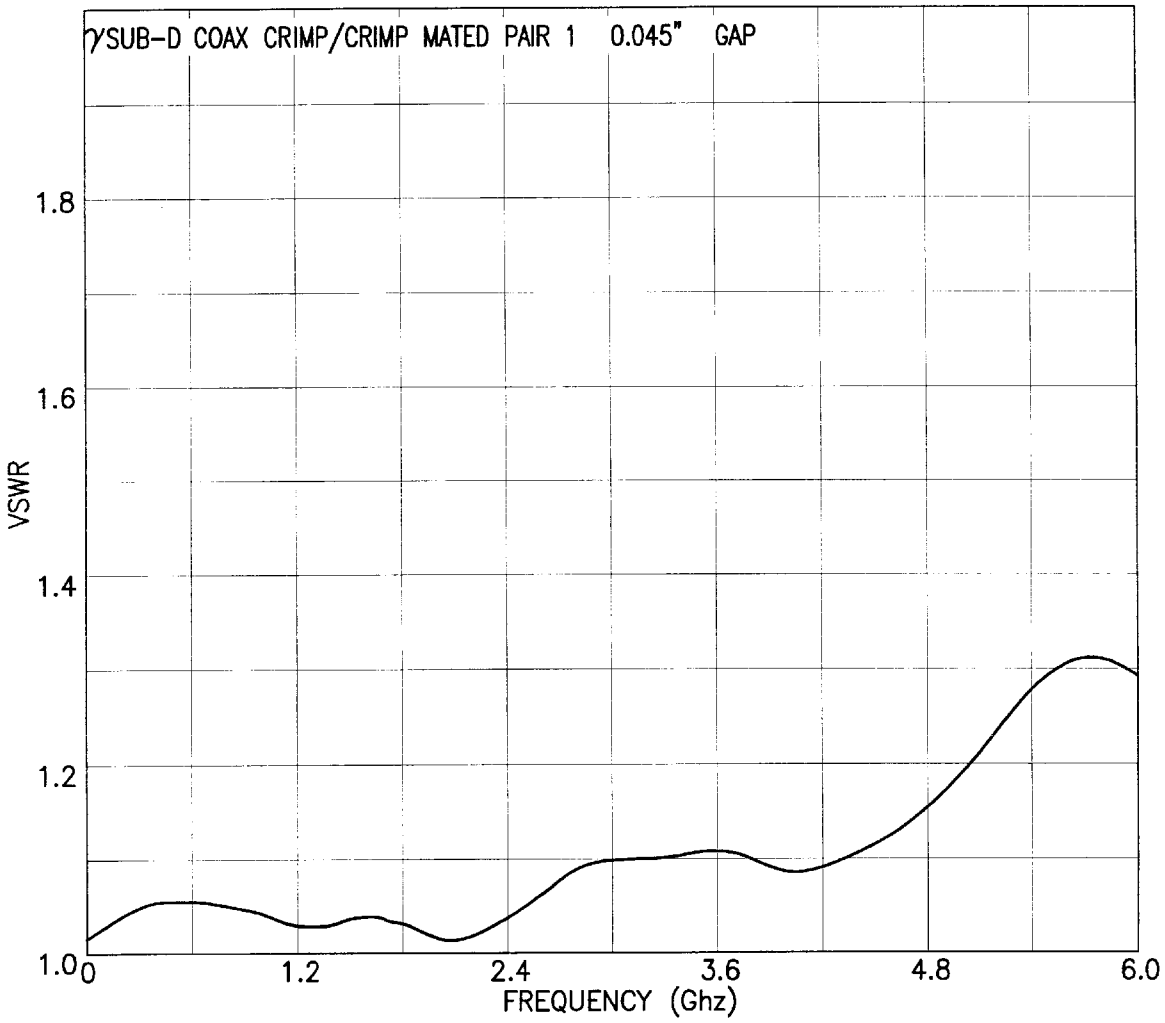
FIGS. 14 and 15 are graphical representations of test data for a connector sub-assembly incorporating features of the present invention.
Figure 15:
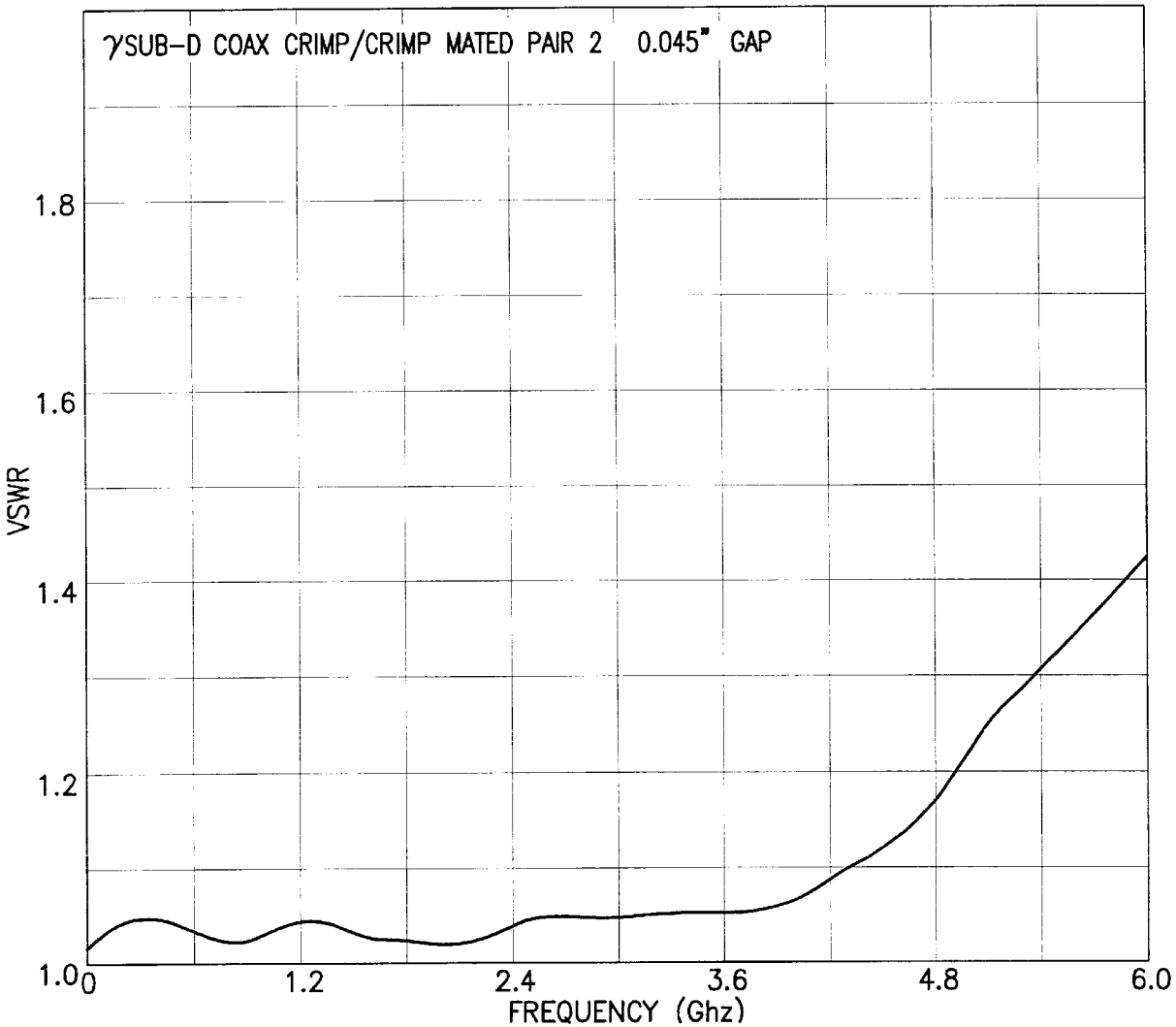

FIGS. 14 and 15 are graphical representations of actual performance test data for connectors 6A and 6B incorporating features of the present invention assessing connector loss in terms of VSWR versus frequency, in gigaHertz. The tests were performed with the connectors in the mated condition shown in FIG. 7. The connector housings were 0.045" (1.143 mm) from a nominal, or fully mated, position.

Figure 16:
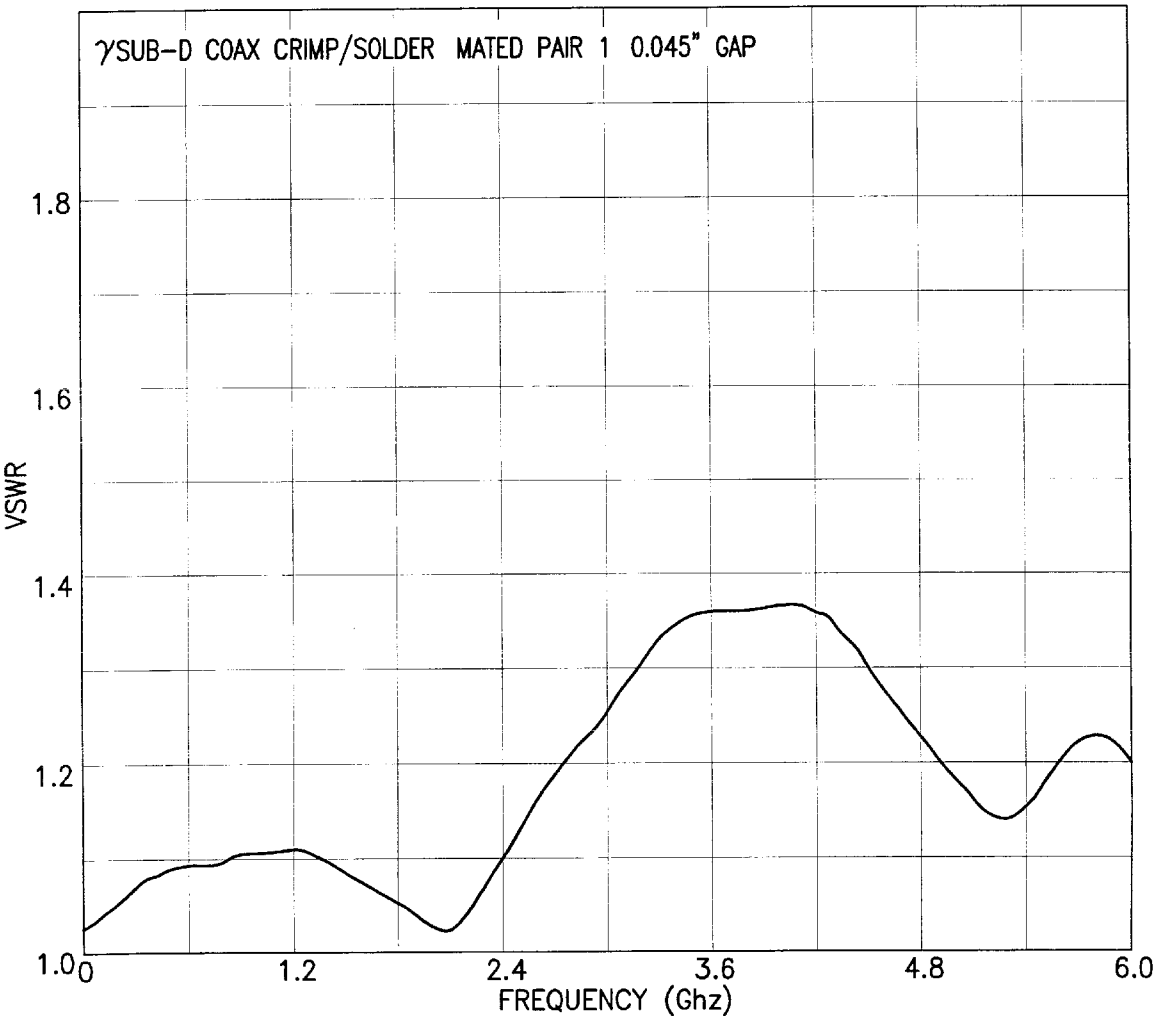
FIGS. 16 and 17 are graphical representations of test data for a connector sub-assembly incorporating a solder termination of the coaxial conductor.
Figure 17:
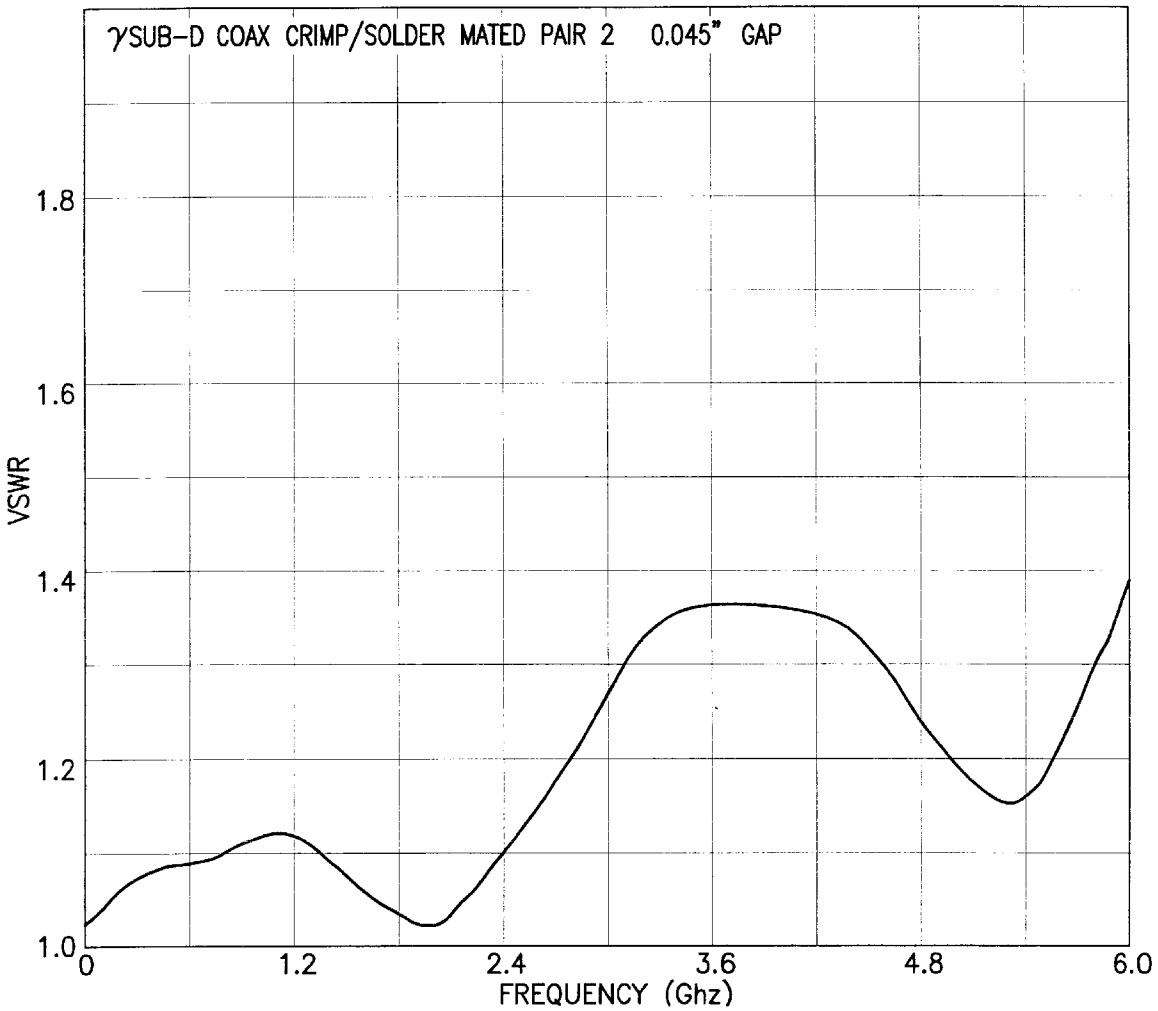
Figure 18:
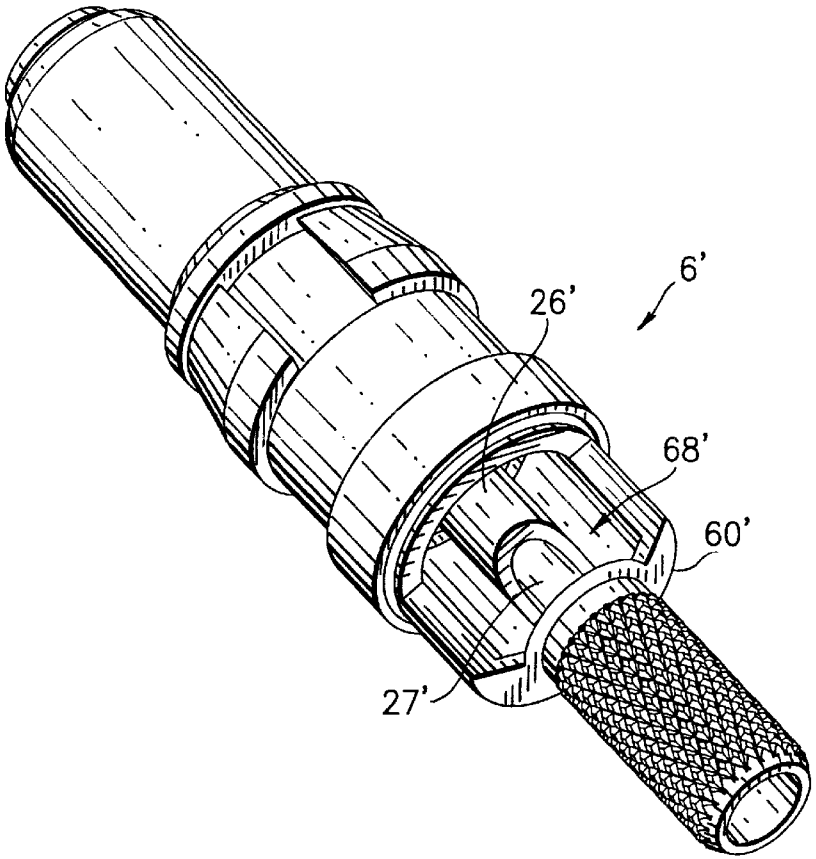
FIG. 18 PRIOR ART
FIG. 18 is an exploded, perspective view of a connector sub-assembly of the prior art.

FIGS. 16 and 17 are graphical representations of actual performance test data of a prior art connector 6', shown in FIG. 18, when mated with a complementary prior art connector, where the conductor 46 of a typical cable 38 is soldered to contact 26'.

Connector 6' has an asymmetric back end 60'. Approximately half of back end 60' is removed, creating an opening 68' that reveals center contact 26'. Center contact 26' includes a solder port 27'. Once the center conductor (not shown) of the coaxial cable (not shown) is placed within center contact 26', solder (not shown) is introduced into solder port 27'. The solder fuses the center conductor of the coaxial cable to center contact 26'. Finally, a ferrule (not shown) is placed over opening 68' and crimped to the braid (not shown) of the coaxial cable. As with FIGS. 14 and 15, these tests were also performed with the connectors in a mated condition such as that shown in FIG. 7. In other words, the connector housings were arranged 0.045" (1.143 mm) from a nominal, or fully mated, position. The test data demonstrates the substantial improvement in terms of electrical performance of the connector 6 of the present invention (FIGS. 14 & 15) over a solder type conductor termination (FIGS. 16 & 17) used with connector 6'.

In one embodiment, referring to FIGS. 6 and 7, the connector 6 is adapted to be used in high frequency applications, such as for example between approximately 1 and 5 gigahertz ("gHz"). Other applications may include the telecommunications industry where a low loss connection is desired.

The size, shape and location of the portals 68, the outer diameter of the center contact 26 and the inner diameter of shell 50 are each a factor in the performance of the assembled connector 6. By placing connector 6 at stop shoulder 110, of positioner 100, which itself has been placed against stop shoulder 150 of tool 130, indenters 102 precisely locate the crimp in the connector 6. The present invention minimizes signal reflections and compensates for those areas of impedance mismatch that cannot otherwise be eliminated within the connector. Thus, the present invention enhances the overall performance of the connector without sacrificing ease of termination.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. An electrical connector member for a coaxial cable comprising:

a first section having two or more portals formed therein, each portal adapted to guide an indentor of a crimping tool into a predetermined position over a crimp area of a conductor receiving section of an electrical contact extending into the first section; and a second section including a conductive outer shell electrically coupled to the first section; and a dielectric material enclosed by the outer shell in the second section supporting the electrical contact in a central bore of the dielectric material, the dielectric material not surrounding the conductor receiving section, the conductor receiving section having a diameter adapted to receive a center conductor of the cable, wherein an electrical connection formed by crimping the electrical contact to the conductor using the indentors extending through the portals provides a substantially matched impedance in that section of the connector;

a void defining an area in the first section surrounding the conductor receiving section; and a crimp ferrule adapted to be inserted over the first section to electrical and mechanically secure a coaxial shield conductor to the connector member and to cover each portal opening to provide an electrical shield against RF leakage from the void area surrounding the conductor receiving section.

2. The connector member of claim 1 wherein the first section and the second section of the member are mated together forming an electrically conductive and mechanically secure connection, and the coaxial cable is crimped in the connector member prior to insertion of the connector member into a respective housing.

3. The connector member of claim 1 wherein the first section and the second section are machined as a one-piece connector member.

4. The connector member of claim 1 wherein the first section includes four portals, each portal being spaced at a location that is 90° from an adjacent portal.

5. The connector member of claim 1 wherein required impedance in a crimp section of the connector member formed by the crimping is approximately 50 ohms.

6. The connector member of claim 1 wherein the connector member is adapted to propagate a signal having a frequency in the range of 1 to 5 gigaHertz (gHz).

7. The connector member of claim 1 wherein a location of a center point of the crimp area on the conductor receiving section is approximately 0.126 inches (3.200 mm) from the front edge of a locator device adapted to position the connector member in the tool.

8. An electrical connector member for a coaxial cable comprising:

a first section having two or more portals formed therein, each portal adapted to guide an indentor of a crimping tool into a predetermined position over a crimp area of a conductor receiving section of an electrical contact extending into the first section; and a second section including a conductive outer shell electrically coupled to the first section; and a dielectric material enclosed by the outer shell in the second section supporting the electrical contact in a central bore of the dielectric material, the dielectric material not surrounding the conductor receiving section, the conductor receiving section having a diameter adapted to receive a center conductor of the cable, wherein an electrical connection formed by crimping the electrical contact to the conductor using the indentors extending through the portals provides a substantially matched impedance in that section of the connector;

a void defining an area in the first section surrounding the conductor receiving section; and a retention clip located on a housing of the second section adapted to retain the assembled and crimped connector member in a connector housing.

9. An electrical connector member for a coaxial cable comprising:

a first section having two or more portals formed therein, wherein each portal extends from a front portion of the first section through a tapered edge along a rear portion of the first section to form a respective groove in the tapered edge, wherein when the connector member is inserted into the crimping tool, the groove aligns the indentors in each portion, and wherein each portal is adapted to guide an indentor of a crimping tool into a predetermined position over a crimp area of a conductor receiving section of an electrical contact extending into the first section;

a second section including a conductive outer shell electrically coupled to the first section; and a dielectric material enclosed by the outer shell in the second section supporting the electrical contact in a central bore of the dielectric material, the dielectric material not surrounding the conductor receiving section, the conductor receiving section having a diameter adapted to receive a center conductor of the cable, wherein an electrical connection formed by crimping the electrical contact to the conductor using the indentors extending through the portals provides a substantially matched impedance in that section of the connector; and a void defining an area in the first section surrounding the conductor receiving section.

10. An electrical connector member for a coaxial cable comprising:

an electrically conductive shell; an electrical contact extending along a portion of a center bore of the shell supported by a first dielectric material, the conductive shell comprising:

a first section including four portals therein, each portal adapted to align a corresponding indentor device over a respective portion of a conductor receiving section of the electrical contact;

a second section electrically connected to the first section, the second section including the dielectric material inserted therein supporting the electrical contact, the conductor receiving section extending out of the first dielectric material and into the first section wherein a center conductor of the cable is adapted to be received through the first section and crimped to the conductor receiving portion inside of the first section;

a crimp ferrule adapted to be inserted over the first section to electrically and mechanically secure a shield conductor of the cable to the connector member and to cover each portal opening to provide a shield against RF leakage; and wherein a void defines an area surrounding a crimped section of the electrical contact and an impedance of the crimped section is substantially matched to an impedance of the cable.

11. The connector member of claim 10 wherein a centerline between crimp points applied by each indentor device to the conductor receiving section is approximately 0.126 inches (3.2004 mm) from an outer edge of the locator shaft.

12. A connector assembly for a coaxial cable comprising:

a plug connector mated to a receptacle connector, wherein each of the plug connector and receptacle connector comprises:

a conductive shell comprising a first section and a second section, the first section housing an electrical contact disposed within a center bore of a dielectric material inserted therein;

a conductor receiving section of the contact extending from the dielectric material into the second section and adapted to receive a center conductor of a first coaxial cable, the second section including four portals in the shell around the conductor receiving section, each portal adapted to receive an indentor of a crimping tool for crimping the conductor receiving section to the center conductor in at least four aligned locations, the second section further including a bore adapted to receive a cable dielectric and center conductor of the first cable on the inside of the bore and a cable shield on an outside of the bore, wherein a void defines an area around a crimp section of the conductor receiving section; and a retention clip on each first section adapted to retain the respective plug connector and receptacle connector in a respective housing member, wherein when the plug connector is coupled to the receptacle connector a nominal distance between a far end of each retention clip is 0.578 inches (14.68 mm).

13. An electrical connector for a coaxial cable, the electrical connector comprising:

an electrical contact having a conductor receiving section, the conductor receiving section comprising a crimp area;

a first portion having a plurality of portals, the conductor receiving section of the electrical contact extending into an open area of the first portion, wherein each portal is adapted to guide an indentor of a crimping tool into a predetermined position over the crimp area of the conductor receiving section of the electrical contact;

a second portion electrically coupled to the first portion, the second portion including a conductive outer shell;

a dielectric member located inside the second portion and supporting the electrical contact therein, wherein an electrical connection formed by crimping the electrical contact to a center conductor of the coaxial cable using the indentors extending through the portals provides a substantially matched impedance; and a crimp ferrule adapted to be located over the first portion to secure a shield conductor of the coaxial conductor to the first portion and to cover the portals, wherein the crimp ferrule is adapted to provide an electrical shield against RF leakage from the open area at the conductor receiving section.

14. A coaxial cable electrical connector comprising:

an electrical contact;

a first portion having a plurality of portals formed therein, wherein the electrical contact extends into an open area of the first portion, and wherein the portals are each adapted to guide an indentor of a crimping tool into a predetermined position over a crimp area of a conductor receiving section of the electrical contact;

a second portion electrically coupled to the first section, the second portion comprising a conductive outer shell;

a dielectric member located in the outer shell in the second section, the dielectric member supporting the electrical contact therein, wherein an electrical connection formed by crimping the electrical contact to a center conductor of a coaxial cable using the indentors extending through the portals provides a substantially matched impedance; and a retention clip located on the second portion, the retention clip being adapted to retain the coaxial cable electrical connector to a connector housing.

15. A coaxial cable electrical connector comprising:

an electrical contact;

a first section having a plurality of portals formed therein, wherein the electrical contact extends into an open area of the first section, wherein each portal extends through a portion of a tapered edge of the first section to form a respective groove in the tapered edge, wherein each portal is adapted to guide an indentor of a crimping tool into a predetermined position over a crimp area of a conductor receiving section of the electrical contact, and wherein, when the first section is inserted into the crimping tool, the grooves are adapted to align the indentors with the first section; and a second section electrically coupled to the first section, the second section comprising a conductive outer shell.

* * * * *